United States Patent [19]

Dove

[11] 4,268,976

[45] May 26, 1981

[54] STEAM DISTRIBUTION APPARATUS

[76] Inventor: Norman F. Dove, 3187 Hoskins Rd., North Vancouver, B.C., Canada, 3TJ 3B5

[21] Appl. No.: 171,482

[22] Filed: Jul. 23, 1980

Related U.S. Application Data

[63] Continuation-in-part of Ser. No. 924,639, Jul. 14, 1978, abandoned.

[51] Int. Cl.[3] ..... D21F 5/00

[52] U.S. Cl. ..... 34/155; 34/160; 162/290; 162/359; 239/553.3; 239/568

[58] Field of Search ..... 162/290, 359, 207; 239/125, 553.3, 568; 34/155, 160, 227, 231, 232, 233; 68/5 A, 6

[56] References Cited

U.S. PATENT DOCUMENTS

| | | | |
|---|---|---|---|
| 1,914,024 | 6/1933 | Kasanof | 34/155 X |
| 2,939,760 | 6/1960 | Bjarnow et al. | 34/155 X |
| 3,097,994 | 7/1963 | Dickens et al. | 34/160 X |
| 3,531,053 | 9/1970 | Miller et al. | 239/553.3 |
| 3,837,789 | 9/1974 | Schindler et al. | 239/568 X |
| 3,850,792 | 11/1974 | Pennington | 162/290 |
| 4,163,688 | 8/1979 | Kankaanpää162 | 162/290 X |

*Primary Examiner*—Richard V. Fisher
*Attorney, Agent, or Firm*—Richard H. Zaitlen

[57] ABSTRACT

A steam distribution apparatus includes a first header having an inlet for steam and a plurality of discrete outlets for steam arranged along the header. The outlets increase in size with distance from the inlet. A first chamber surrounds the first header to receive steam from the outlets in the first header. There are first, relatively large outlets in the first chamber. The relative positions of the first header and the first chamber ensure that steam leaving the plurality of outlets in the first header impinges on the interior of the chamber and must travel around the chamber to reach the first outlets in the first chamber. A second chamber communicates with the first outlets from the first chamber. There are outlets in the second chamber. A shrouding is positionable above a paper web and communicates with the elongate outlets in said second chamber. The apparatus permits uniform steam flow along the entire length of the distributor.

9 Claims, 7 Drawing Figures

STEAM DISTRIBUTION APPARATUS

CROSS REFERENCE TO RELATED APPLICATIONS

This application is a continuation-in-part of my application Ser. No. 924,639 filed July 14, 1978, now abandoned.

FIELD OF THE INVENTION

This invention relates to a steam distribution apparatus particularly useful in paper making.

DESCRIPTION OF THE PRIOR ART

During the paper making process it is frequently necessary to provide steam along a relatively long distance, for example the application of steam in the press section of pulp and paper making machines. It is clearly desirable to provide a uniform source of steam across the relatively great width of the web but, previously, the provision of such a uniform source has been difficult.

SUMMARY OF THE INVENTION

The present invention seeks to provide a steam distribution apparatus in which uniform steam flow along the entire length of the apparatus and thus across the whole width of a paper web can be achieved.

Accordingly, in a preferred aspect, the present invention is a steam distribution apparatus comprising a header having means defining an inlet for steam and means defining a first plurality of discrete outlets for steam arranged along the header, the outlets increasing in size with distance from the inlet; means defining a first chamber surrounding the header to receive steam from the outlets in said header; means defining first, relatively large outlets in said first chamber; the relative positions of the header and the first chamber ensuring that, in use, steam leaving said plurality of outlets in the header impinges on the interior of the chamber and must travel around the chamber to reach the first outlets in the first chamber, the exterior of the header being relatively close to that part of the first chamber containing the first outlets so as to form a restricted zone immediately before said outlets to assist in obtaining uniform steam pressure along the length of the steam distribution apparatus; means for defining a second chamber communicating with said first outlets from the first chamber; means defining outlets in said second chamber; a shrouding positionable above a paper web and communicating with said outlets in said second chamber whereby, in use, uniform steam flow along the entire length of the steam distribution apparatus can be achieved.

Preferably there are second, relatively small outlets in said first chamber communicating with the shrouding. These permit steam to be directed downwardly at the leading edge of the distribution apparatus to contact a web moving beneath the apparatus and to prevent air being drawn into the shrouding by the moving web. The leading edge of the apparatus is the edge under which the web passes first as it enters the shrouding.

The exterior of the first header is relatively close to that part of the first chamber containing the first outlets. A baffle can, in one embodiment, extend from the exterior of said header to adjacent the outlet to assist in forming the restricted zone immediately before the outlets.

In a further aspect the second chamber is divided into a plurality of compartments. There are a plurality of pipes, generally one to each compartment. Each pipe has an inlet communicating with the first chamber and an outlet communicating with one of the above compartments. Each pipe extends outwardly from the first chamber and then returns through the first chamber to an outlet. There is a valve in each pipe to regulate steam flow through the pipe. Such an arrangement permits control of steam flow across a web, a procedure known in the art as profiling.

It is desirable that there be an insulating jacket extending around the apparatus.

The outlets in the second chamber may be in the form of one or more continuous slots or they may be slots arranged in two discrete rows with a plurality of discrete slots in each row. The outlets may also be holes arranged in rows. The outlets in each row should be staggered relative to the outlets in the other row.

BRIEF DESCRIPTION OF DRAWINGS

Aspects of the invention are illustrated, merely by way of example, in the accompanying drawings in which.

DESCRIPTION OF PREFERRED EMBODIMENTS

The drawings illustrate a steam distribution apparatus comprising a first header 2 having an inlet 4 for steam and a plurality of discrete outlets 6 for steam. These outlets 6 generally increase in size with distance from the inlet 4. It is generally convenient that they proceed in a plurality of steps. That is the outlets may be arranged in groups, the group nearest the inlet 4 having one diameter, a second group having a larger diameter and so on through the outlets 6 most remote from the steam inlet 4, which have the greatest diameter.

Figure 1:
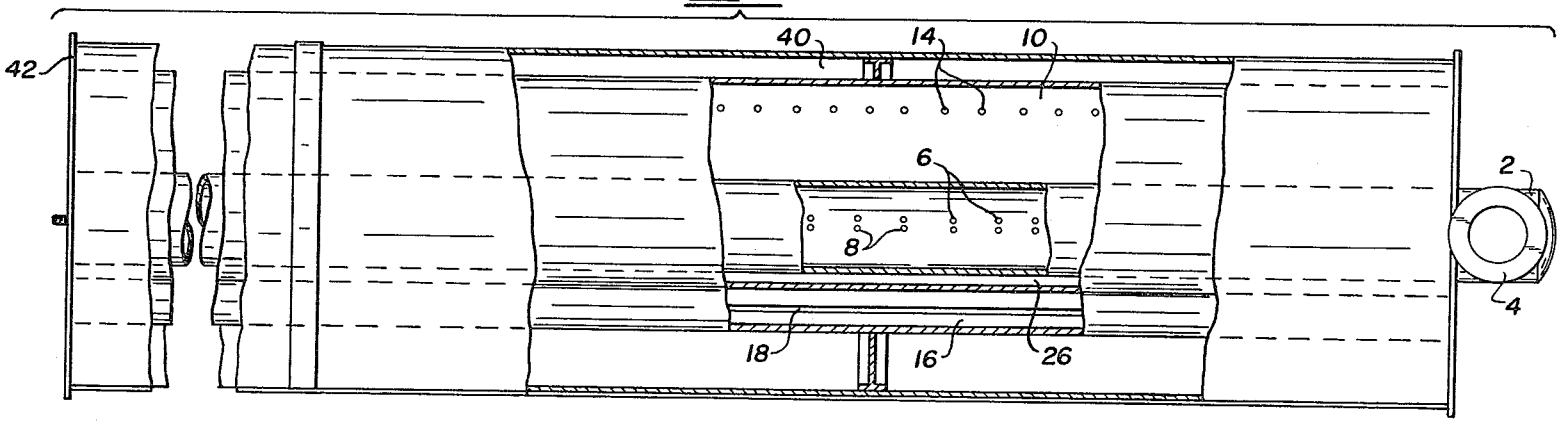
FIG. 1 is a plan view of an apparatus according to the present invention.
Figure 2:
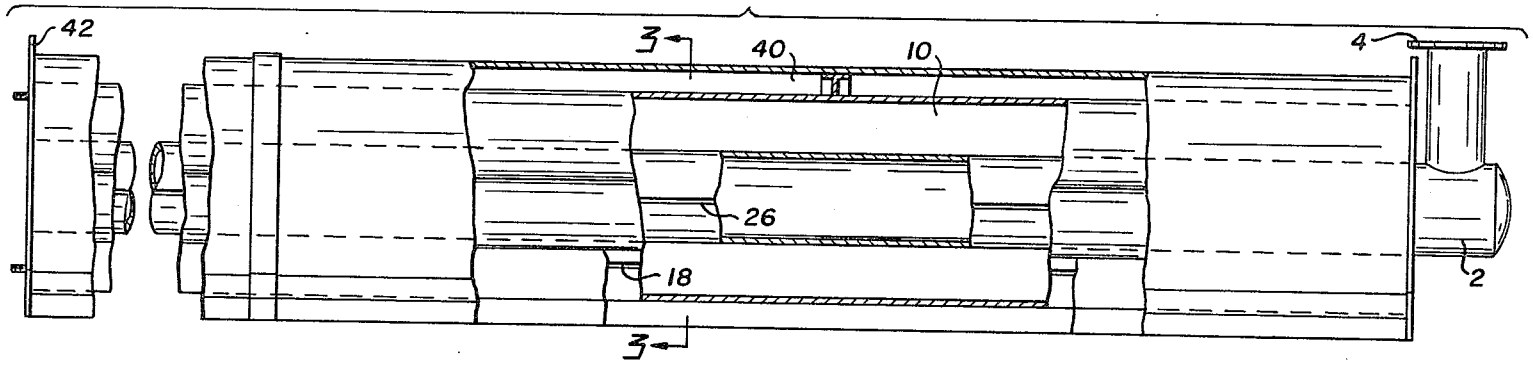
FIG. 2 is an elevation of the apparatus of FIG. 1.
Figure 3:
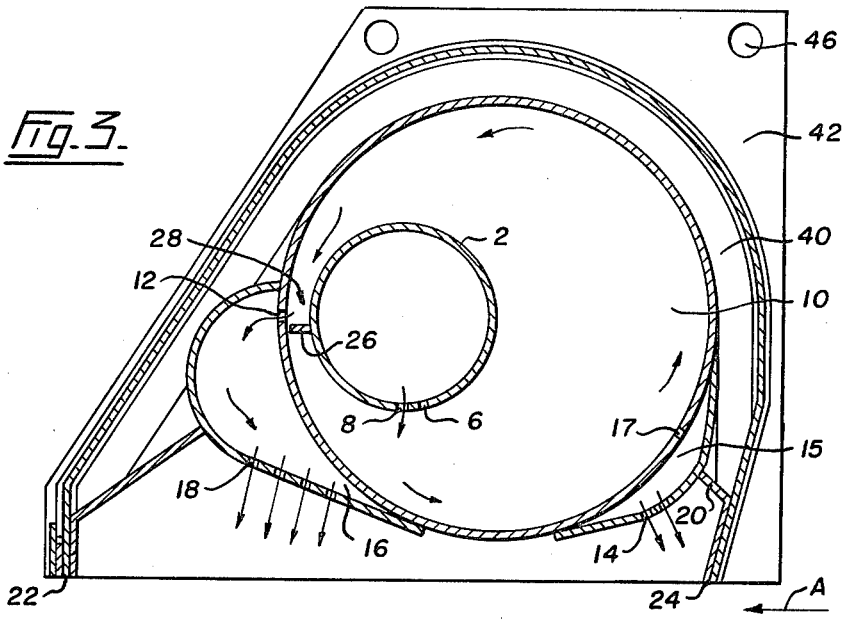
FIG. 3 is a section along the line 3—3 in FIG. 2.

In the embodiment illustrated in FIGS. 1 to 3 there is a second plurality of discrete steam outlets 8 of uniform size along the first header 2, adjacent the first plurality of outlets 6. However, this second set of uniform, discrete outlets 8 is not essential to the invention.

There is a first chamber 10 surrounding the first header 2 to receive steam from the outlets 6 in said first header 2. First, relatively large outlets 12 (see FIG. 3) and second, relatively small outlets 14 are positioned in said first chamber 10. The outlets 14 are positioned in a small compartment 15 added to the exterior of the first chamber 10. Openings 17 permit access between first chamber 10 and compartment 15. The compartment 15 tends to create a uniform steam flow from outlets 14.

Outlets 14 operate to provide a steam curtain to prevent air being drawn in by the belt or web moving below the distribution apparatus in the direction of the arrow A. The arrangement is described and claimed in my copending application that is a continuation of my application Ser. No. 924,399, filed July 14, 1978, now abandoned; the disclosure of the continuation application is incorporated by reference.

Figure 4:
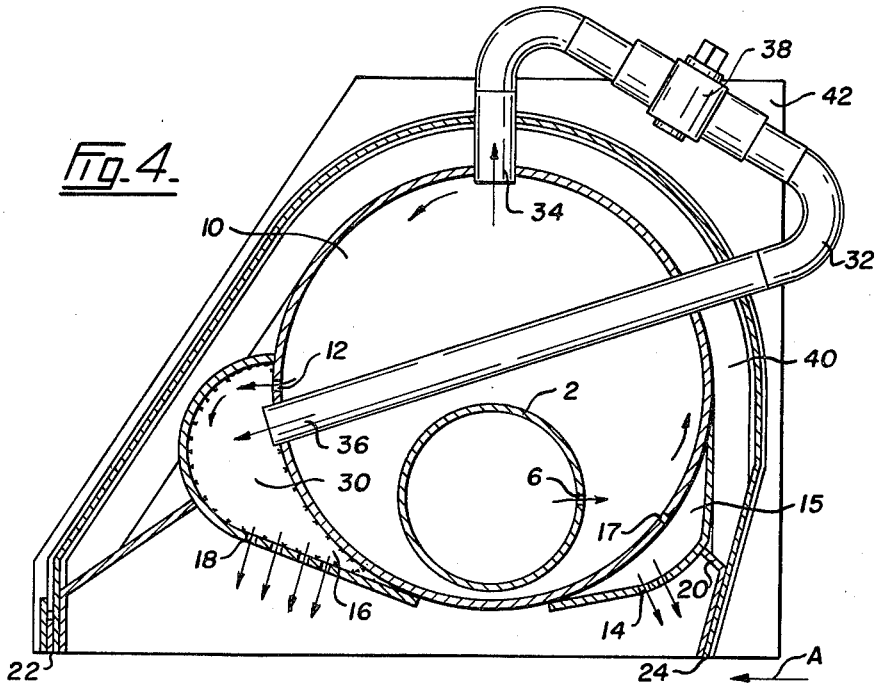
FIG. 4 is a view similar to that of FIG. 3 but illustrating a modification of the invention.

As most clearly shown in FIGS. 3 and 4, the relative positions of the first header 2 and the first chamber 10 are such as to ensure that in use steam leaving said plurality of outlets 6 in the first header 2 impinges on the interior of the first chamber 10 and must travel around the chamber 10 to reach the first outlets 12 in the first chamber 10. The direction of flow of steam is shown in FIGS. 3 and 4 by arrows. In both cases the flow starts at the first header 2.

Figure 5A:
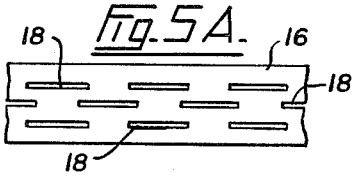
FIG. 5A is a detail section of the outlets in FIG. 4.
Figure 5B:
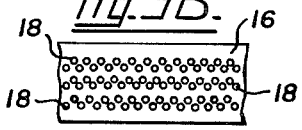
FIGS. 5B and 5C illustrate variations in the outlets pattern.
Figure 5C:
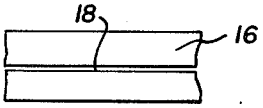

There is a second chamber 16 communicating with the first chamber 10 near the first outlets 12 in the first chamber 10. Thus steam leaves the first header 2 passes around the interior of the first chamber 10, out through the outlets 12 into the second chamber 16. There are outlets 18 in the second chamber 16. The outlets 18 may comprise a single slot extending the length of the second chamber 16 (FIG. 5C) or may be of the pattern shown in FIG. 5A, that is slots arranged in rows, the elongate outlets in each row being staggered relative to the elongate outlets in the other row, or may be circular holes arranged on isometric centres, for example, as shown in FIG. 5B.

There is a shrouding 20 into which steam from the second chamber 16 passes from the outlets 18. Shrouding 20 forms a heating zone in which the steam is directed onto a paper web when the steam distribution apparatus is in use. Steam also passes directly from the first chamber 10 through the second, relatively small outlets 17 to the chamber 15 and through outlets 14 to the shrouding 20. Thus there is a uniform steam distribution at the leading edge 22 and the trailing edge 24 of the steam distribution apparatus-see FIGS. 3 and 4.

FIG. 3 illustrates an embodiment of the invention in which the first header 2 is positioned relatively close to that part of the first chamber 10 containing the first outlets 12. There is a baffle 26 extending from the exterior of the header 2 to adjacent and just below the outlets 12. The effect of both the positioning of the first header 2 relatively close to the wall of the first chamber 10 and the positioning of the baffle 26 creates a restricted zone generally indicated at 28 immediately before the outlets 12 and this smooths out steam pressure differences in the cross-machine direction to produce uniform steam flow from the first chamber 10 to the second chamber 16.

In the embodiment illustrated in FIG. 4 the second chamber 16 is divided into compartments by walls 30, one of which is shown in FIG. 4. There are a plurality of pipes 32 each having an inlet 34 communicating with said first chamber 10 and an outlet 36 communicating with one of said compartments of said second chamber 16. Each pipe 32 extends outwardly from the first chamber 10 and then returns to a compartment in the second chamber 16 through an outlet 36. There is a valve 38 in each pipe 32 adjustable to regulate steam flow through the pipe.

In both FIGS. 3 and 4 the apparatus is provided with an insulating jacket 40 that extends around the apparatus to minimize heat losses.

The apparatus of the present invention has end plates 42 having holes 46—see particularly FIG. 3—to provide a means of lifting the unit. It is mounted by brackets (not shown).

The steam distribution apparatus of the present invention provides a uniform source of steam across a relatively long length for, for example, application in the press sections of pulp and paper making machines. The invention ensures uniform pressure across the entire length of the steam distribution apparatus so that there is a uniform source of steam discharging from the unit across its entire length for all variations in steam flow rates. For example the unit is effective for a steam turn down ratio of at least 5 to 1.

The unit of FIG. 4, which includes a plurality of pipes 32 permits incremental moisture profile control. This profiling is done by tapping steam from the top of the first chamber 10 and by controlling the flow of the tapped steam by the valve 38. The separation of the second chamber 16 into separate compartments means that incremental flow can be established. Furthermore, by passing the profiling pipes 32 through the first chamber 10 any condensate contained in the steam will tend to evaporate.

A further advantage of the steam distribution apparatus is compact installation.

Dimensions of the apparatus may be varied within limits easily ascertainable by calculation.

I claim:

1. A steam distribution apparatus comprising:

a header having means defining an inlet for steam and means defining a first plurality of discrete outlets for steam arranged along the header, the outlets increasing in size with the distance from the inlet;

means defining a first chamber surrounding the header to receive steam from the outlets in said header;

means defining first, relatively large outlets in said first chamber;

the relative positions of the header and the first chamber ensuring that, in use, steam leaving said plurality of outlets in the header impinges on the interior of the chamer and must travel around the chamber to reach the first outlets in the first chamber, the exterior of the header being relatively close to that part of the first chamber containing the first outlets so as to form a restricted zone immediately before said outlets to assist in obtaining uniform steam pressure along the length of the steam distribution apparatus;

means for defining a second chamber communicating with said first outlets from the first chamber;

means defining outlets in said second chamber; and a shrouding positionable above a paper web and communicating with said outlets in said second chamber whereby, in use, uniform steam flow along the entire length of the steam distribution apparatus can be achieved.

2. A steam distribution apparatus as claimed in claim 1 including means defining a second plurality of discrete outlets for steam of uniform size along said header, adjacent the first plurality of outlets.

3. A steam distribution apparatus as claimed in claim 1 including means defining second, relatively small outlets in said first chamber communicating with the shroud, whereby steam can be directed downwardly at an edge of the distribution apparatus to contact a web moving beneath the apparatus when it is in use, the steam acting to prevent the web drawing air into the shrouding.

4. A steam distribution apparatus as claimed in claim 3 in which said second outlets in the first chamber are formed in a compartment to the first chamber, means defining third outlets in said first chamber whereby steam may pass from said first chamber to said compartment.

5. Steam distribution apparatus as claimed in claim 3 in which the outlets in said second chamber and said second outlets in said first chamber comprises openings arranged in a plurality of pairs of rows, the openings in each pair of rows being arranged on isometric centres.

6. Steam distribution apparatus as claimed in claim 1 including an insulating jacket extending around the apparatus.

7. Steam distribution apparatus as claimed in claim 1 in which the outlets in said second chamber are arranged in rows, the outlets in each row being staggered relative to the outlets in the neighbouring row.

8. A steam distribution apparatus comprising:

a header having means defining an inlet for steam and means defining a first plurality of discrete outlets for steam arranged along the header, the outlets increasing in size with distance from the inlet;

means defining a first chamber surrounding the header to receive steam from the outlets in said header;

means defining first, relatively large outlets in said first chamber;

the relative positions of the header and the first chamber ensuring that, in use, steam leaving said plurality of outlets in the header impinges on the interior of the first chamber and must travel around the first chamber to reach the first outlets in the first chamber, the exterior of the header being relatively close to that part of the first chamber containing the first outlets;

a baffle extending from the exterior of said header to adjacent the first outlets such that a restricted zone is formed immediately before said first outlets to assist in obtaining uniform steam pressure along the length of the steam distribution apparatus;

means defining a second chamber communicating with said first outlets from the first chamber;

means defining outlets in said second chamber; and a shrouding positionable above a paper web and communicating with said outlets in said second chamber whereby in use, uniform steam flow along the entire length of the steam distribution apparatus can be achieved.

9. A steam distribution apparatus comprising:

a header having means defining an inlet for steam and means defining a first plurality of discrete outlets for steam arranged along the header, the outlets increasing in size with distance from the inlet;

means defining a first chamber surrounding the header to receive steam from the outlets in said header;

means defining first, relatively large outlets in said first chamber;

the relative positions of the header and the first chamber ensuring that, in use, steam leaving said plurality of outlets in the header impinges on the interior of the first chamber and must travel around the first chamber to reach the first outlets in the first chamber;

means defining a second chamber communicating with said first outlets from the first chamber, said second chamber being divided into compartments;

a plurality of pipes each having an inlet communicating with said first chamber and an outlet communicating with a compartment in said second chamber, each said pipe extending outwardly from said first chamber and then returning through said first chamber to a compartment in said second chamber;

a valve in each pipe to regulate steam flow through the pipe;

means defining outlets in said second chamber; and a shrouding positionable above a paper web and communicating with said elongate outlets in said second chamber whereby in use, uniform steam flow along the entire length of the steam distribution apparatus can be achieved.

* * * * *